US006286497B1

(12) United States Patent
Levkov

(10) Patent No.: US 6,286,497 B1
(45) Date of Patent: Sep. 11, 2001

(54) AIR VALVE AND REGULATOR

(76) Inventor: Sergey Levkov, 24932 Ave. Kearing #1, Valencia, CA (US) 91355

( * ) Notice: Subject to any disclaimer, the term of this patent is extended or adjusted under 35 U.S.C. 154(b) by 0 days.

(21) Appl. No.: 09/335,311

(22) Filed: Jun. 16, 1999

Related U.S. Application Data

(60) Provisional application No. 60/089,462, filed on Jun. 16, 1998.

(51) Int. Cl.[7] ..... F41B 11/00
(52) U.S. Cl. ..... 124/73
(58) Field of Search ..... 124/74, 75, 73

(56) References Cited

U.S. PATENT DOCUMENTS 3,735,747 * 5/1973 Barjavel ..... 124/74
5,265,582 * 11/1993 Bhogal ..... 124/73
5,450,839 * 9/1995 Nicolaevich et al. ..... 124/73
5,476,087 * 12/1995 Kunimoto ..... 124/73
5,477,843 * 12/1995 Kunimoto ..... 124/73
5,613,483 * 3/1997 Lukas et al. ..... 124/73
5,913,303 * 6/1999 Kotsiopoulos ..... 124/31

* cited by examiner

*Primary Examiner*—Kurt Rowan
(74) *Attorney, Agent, or Firm*—Roger A. Marrs

(57) ABSTRACT

An air valve and regulator system for an air gun includes a cylindrical body having an internal air chamber operably connected at one end to a high pressure air supply. The other end of the cylinder is provided with a discharge orifice having a conical or frustro-conical member mounted coaxially with the cylinder and which partially occupies the discharge orifice so that exhausting air strikes the tapered surface and is distributed in a radial direction exteriorly of the air gun. A support brace mounts the member across the orifice and the surrounding surface of the discharge orifice is similarly tapered so that its surface is parallel with the exterior surface of the member. The space in between represents a circular discharge opening or orifice through which the high pressure exhaust is directed exteriorly of the gun. A regulator valve stem and regulator seal in movable relationship with respect to the member is provided so that reciprocal movement is permitted between the member and the stem.

16 Claims, 2 Drawing Sheets

FIG. 1
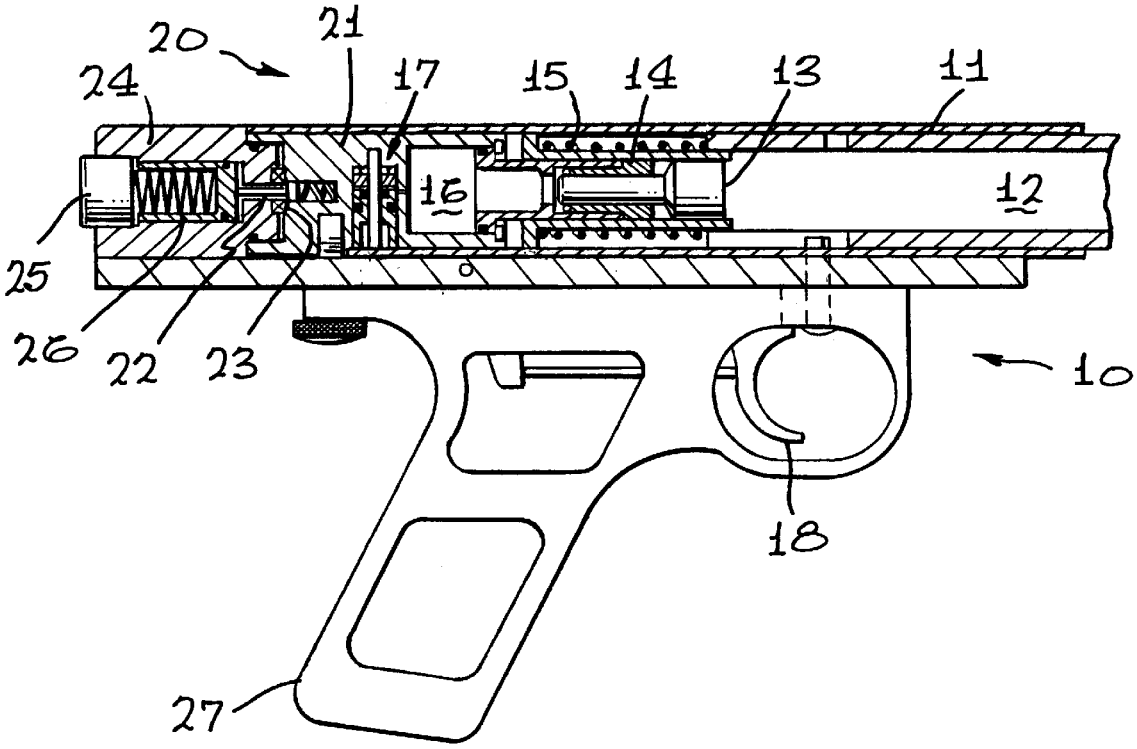
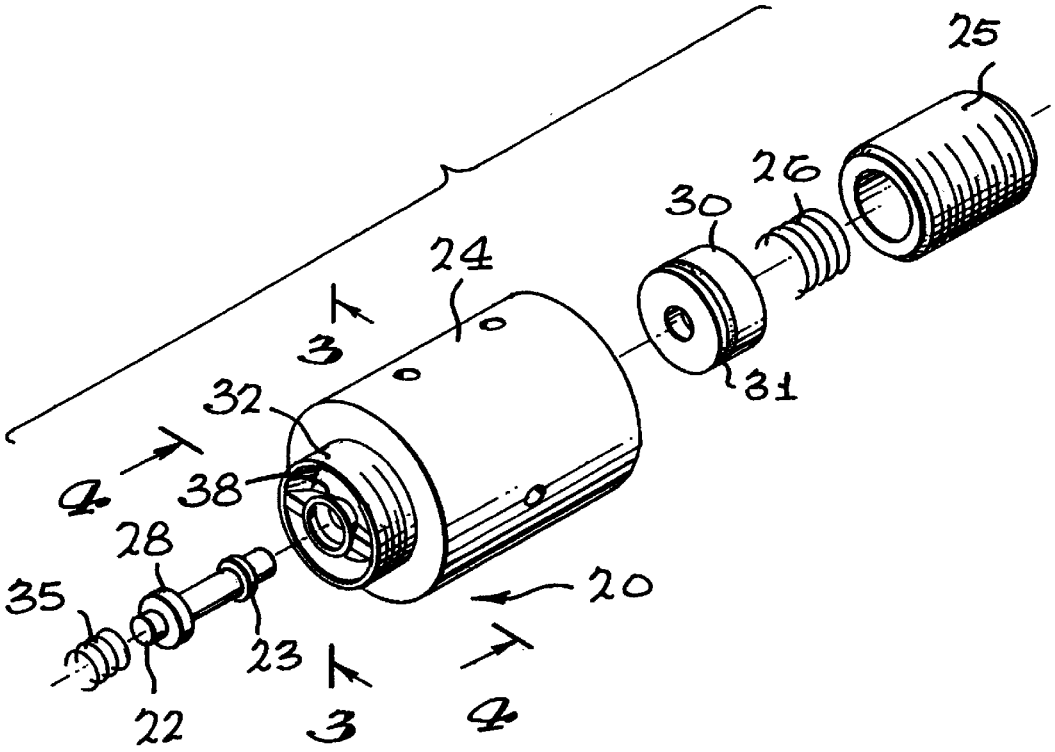
FIG. 2

FIG. 3
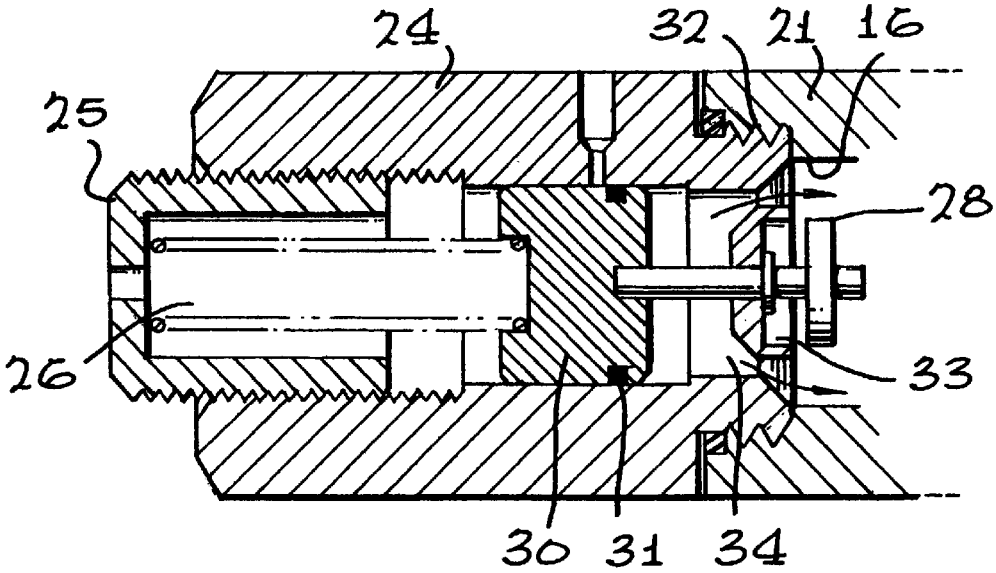
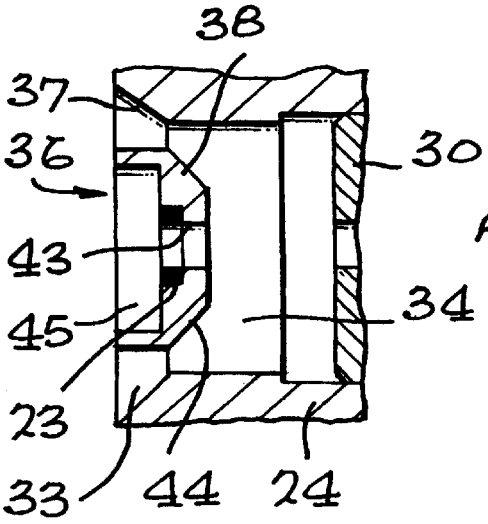
FIG. 4
FIG. 5
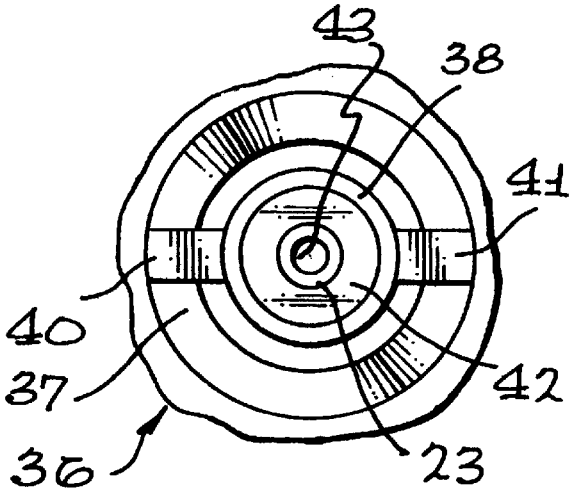

AIR VALVE AND REGULATOR

Priority claimed on Ser. No. 60-089,462 filed Jun. 16, 1998.

BACKGROUND OF THE INVENTION

1. Field of the Invention

The present invention relates to the field of pneumatic guns having an internal pressurized air supply for propelling a missile, such as a paint ball and more particularly to a novel pressure air valve and regulator assembly which includes an exhaust means for distributing exhaust air in a radial pattern for efficiency purposes.

2. Brief Description of the Prior Art

It has been the conventional practice in the field of air guns and the like to provide a pressurized means for propelling a missile, such as a paint ball, from the gun at one end of the barrel. At the other end of the barrel, air regulator means and air valve is provided for exhausting a high pressure air from the discharge of the gun exteriorly of the barrel. In this connection, an exhaust orifice is provided from an air chamber which conducts the high pressure air exteriorly of the barrel. Problems and difficulties have been encountered with conventional air valve and regulator systems which stem largely from the fact that the exhaust opening or orifice for the exhaust air is greatly restricted and even when exhausted, the exhaust discharge is in a single direction which causes the discharge to be at high pressure. In other words, no means is provided in a conventional air pressure exhaust system for conveniently splitting the exhaust discharge so that pressure is reduced and which provides a sufficient opening for the exhaust so that, again, the pressure is reduced.

Therefore, a long-standing need has existed to provide an air gun with a high pressure exhaust system that not only provides for maximum orifice opening for the discharge port but provides a distribution means in the contour of the port for distributing the high pressure exhaust in a radial direction.

SUMMARY OF THE INVENTION

Accordingly, the above problems and difficulties are avoided by the present invention which provides a novel air valve and regulator system which includes a cylindrical body having an internal air chamber operably connected at one end to a high pressure air supply or source. The other end of the cylinder is provided with a discharge orifice having a conical or frustro-conical member mounted coaxially with the cylinder and which partially occupies the discharge orifice so that exhausting air strikes the tapered surface and is distributed in a radial direction exteriorly of an air gun. The discharge orifice includes a support brace or member for the frustro-conical member and the surrounding surface of the discharge orifice is similarly tapered so that its surface is parallel with the exterior surface of the conical member. The space in between represents a circular discharge opening through which the high pressure exhaust is directed exteriorly of the gun. A feature resides in providing a regulator valve stem and regulator seal in movable relationship with respect to the conical member so that reciprocal movement is permitted between the conical member and the stem.

Therefore, it is among the primary objects of the present invention to provide a novel discharge orifice for a high pressure exhaust system having an air valve and regulator which permits high pressure air to be discharged by disbursing or distributing the discharge air in a radial pattern.

Another object of the present invention is to provide a novel air valve and regulator means including a discharge orifice having a conical member for redirecting high pressure exhaust air into the radial distribution exteriorly of an air gun.

Still a further object is to provide a novel air discharge system for high pressure air in an air gun comprising a circular discharge orifice having a conical member fixedly disposed in the center thereof and tapered wall surfaces in spaced-apart relationship with respect to the conical member so that the discharge orifice includes an increasing diameter discharge opening for exhausting of the discharge air.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a partial sectional view of an air gun incorporating the novel air valve and regulator means of the present invention;

FIG. 2 is an enlarged exploded perspective view showing the inventive air valve and regulator means used in the air gun shown in FIG. 1;

FIG. 3 is a sectional view of an assembled air valve and regulator means as shown in FIG. 2;

FIG. 4 is a fragmentary sectional view showing the discharge orifice incorporated into the air valve and regulator means of the present invention as taken in the direction of arrows 4—4 of FIG. 2;

FIG. 5 is a transverse cross-sectional view of the air valve and regulator means shown in FIG. 2 as taken in the direction of arrows 5—5 thereof and further illustrating the radial air distribution at discharge.

DESCRIPTION OF THE PREFERRED EMBODIMENT

Referring to FIG. 1, an air gun is represented in the general direction of arrow 10 which includes an elongated barrel 11 having a central bore 12 into which a missile, such as a paint ball or the like, is loaded and discharged. This aspect of the air gun is not intended to be covered by the present invention and therefore, details are not illustrated. However, in order to fire or discharge the missile, the conventional air gun includes a bolt 13 and a power tube insert 14 as well as a bolt spring 15. An air chamber is illustrated immediately behind the bolt 13 and the air chamber is indicated by numeral 16. Numeral 17 illustrates the back side of the air chamber which may readily mount a conventional on/off valve assembly including an on/off pin. Immediately behind the valve assembly 17, there is provided an air valve and regulator means for accommodating the discharge of high pressure air after firing of the air gun.

The air valve and regulator means in accordance with the present invention includes a regulator valve body 21 which houses a regulator valve 22 taking the form of a plunger adapted to move rectilinearly through the valve body. A regulator seal 23 causes the regulator valve plunger to slide easily through the valve. The regulator body is indicated by numeral 24 and a regulator nut 25 completes the regulator assembly. A regulator spring pack is indicated by numeral 26. To complete an over-all air gun, a trigger mechanism 18 is included which is operably connected to the firing mechanism to cause discharge of the missile through the bore 12 in the barrel. 11. The trigger mechanism is immediately ahead of a hand grip 27.

Referring now in detail to FIG. 2, the regulator valve body 24 is seen to terminate at one end with a central mounting for the plunger 22 and-the regulator seal 23. The plunger 22 includes an enlarged stop 28 at one end while its opposite end is carried on a piston 30, more clearly shown in FIG. 3. The piston 30 includes a seal 31 which permits the piston to slide within a smooth bore in the regulator body 24. It can also be seen in FIGS. 2 and 3 that the regulator nut 25 is threadably carried in the end of regulator body 24 and that the nut serves as a backstop for the piston 30. The end of the regulator body 24 terminates in a threaded stud 32 that is in threadable engagement with the body 21 at the end of barrel 11. Therefore, it can be seen that the end of the plunger 22 carrying the stop 28 is within the air chamber 16 at the control of the on/off valve assembly. Due to the expansion of spring 26, the piston 30 and the plunger 22 are moved so that the enlarged or stop end of the plunger 22 resides within the chamber to that a discharge passageway is provided from the chamber through an orifice 33 into a discharge chamber 34.

It is the arrangement and construction of the discharge orifice which forms the primary object of the present invention and is more clearly shown in FIGS. 4 and 5.

The regulator valve taking the form of plunger 22 and a return spring 35 are held in place by spring pressure and operate as one unit. Should the regulator valve malfunction such as when the critical seal 23 is dirty or leaks, the air gun will go to full pressure, the trigger becomes rigid and the blow-off valve vents out the rear of the gun via the discharge orifice, indicated in the general direction of arrow 36. In conventional air guns, the discharge orifice is a mere circular hole and as such, greatly restricts the passage of high pressure air. Therefore, it is a primary purpose of the present invention to provide a greatly enlarged orifice which not only increases the area for discharge of high pressure air but will suitable mount the regulator valve for rectilinear motion. In this connection, the orifice 36 includes a circular tapered outer wall diverging from the air chamber 34,outward of the threaded stud 32. The tapered wall is indicated by numeral 37 and is coaxially disposed with respect to the bore defining air chamber 34. A mount for the regulator valve 22 is constructed by means of a frusto-conical member 38 held in fixed spaced-apart relationship with respect to the tapered wall surface 37 by means of a pair of trace elements 40 and 41 seen more clearly in FIG. 5. The member 38 includes a back wall 42 which is provided with a hole 43 for slidably accepting the plunger shaft of the regulator valve 22. The rear surface of the member 38 within the chamber 34 is tapered in parallel with the diverging tapered wall surface 37. The discharge of high pressure air from chamber 34 is permitted between the wall surfaces 37 and 44, as shown in FIG. 4 in the direction of the arrows. The plunger shank of the regulator valve moves in a rectilinear manner within the hole 43 and the inclusion of the regulator seat or seal 23 prevents leakage of air between the shank of the plunger and its mounting member. The mounting member 38 also includes an enlarged opening 45 for receiving the enlarged head 28 of the regulator valve plunger 22 as the plunger moves back and forth through the hole 43.

Referring now in detail to FIG. 5, it can be seen that the only areas blocking discharge of high pressure air are the brace members 40 and 41 and the mounting member 38. A substantial area is provided with an upper semi-circle represented on one side of the brace members and lower semicircular discharge area represented on the other side of the brace members. The output of discharge air is in the direction of the arrows, as illustrated.

Therefore, in view of the foregoing, it can be seen that an improved air valve and regulator is provided because of the enlarged discharge area provided for high pressure air and which permits the mounting of the regulator valve and its plunger in the same discharge orifice.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An air regulator system for an air gun comprising:

a cylindrical body having an internal air chamber;

an orifice provided in said cylindrical body and in communication with said internal air chamber;

a dispersal member mounted in said orifice in coaxial relationship with said cylindrical body;

brace means supporting said dispersed member in fixed, spaced-apart relationship with respect to said cylindrical body; and said dispersal member occupying said orifice so that exhausting air from said internal air chamber strikes said dispersal member and is distributed in a radial direction exteriorly of said internal air chamber.

2. The air valve and regulator system defined in claim 1 wherein:

said dispersal member includes a continuous external tapered surface for interfering with exhausting air so as to redirect exhausting air through said orifice.

3. The air valve and regulator system defined in claim 2 wherein:

said cylinder including a tapered wall defining said orifice in space-apart relationship with respect to said continuous external tapered surface of said dispersal member.

4. The air valve and regulator system defined in claim 3 wherein:

said tapered surface of said orifice and said tapered surface of said dispersal member are parallel.

5. The air valve and regulator system defined in claim 4 wherein:

a circular discharge opening defined between said tapered surface of said orifice and said tapered surface of said dispersal member constituting a circular passageway for conducting regulated gas from said internal air chamber.

6. The air valve and regulator system defined in claim 5 including:

a regulator valve stem and seal arrangement movably carried on said dispersal member permitting reciprocal movement between said dispersal member and said regulator valve stem and seal arrangement.

7. The air valve and regulator system defined in claim 5 wherein:

said dispersal member is shaped as either conical or frustro-conical.

8. The air valve and regulator system defined in claim 5 wherein:

said circular passageway defines an increasing diameter opening for regulated gas from said internal chamber.

9. The regulator system defined in claim 1 wherein:

said cylindrical body including a tapered wall defining said orifice in spaced-apart relationship with respect to said annular continuous external tapered surface of said dispersal member.

10. The regulator system defined in claim 9 wherein:

said tapered surface of said orifice and said tapered surface of said dispersal member are parallel and in coaxial fixed spaced-apart relationship.

11. The regulator system defined in claim 4 wherein:

a circular discharge opening defined between said tapered surface of said orifice and said tapered surface of said dispersal member constituting a circular passageway for conducting regulated gas from said internal air chamber.

12. The regulator system defined in claim 11 including:

a regulator valve stem and seal arrangement movably carried on said dispersal member permitting reciprocal movement between said dispersal member and said regulator value stem and seal arrangement.

13. In an air gun having an air valve and regulator system, the improvement which comprises:

an elongated cylinder having an internal air chamber with a pair of ends;

a high pressure air supply connected to a selected end of said air chamber;

an air arrangement carried on said select end of said air chamber;

said air discharge arrangement including a circular passageway having a chambered, conical discharge exit and a conical dispersement member fixly mounted in said passageway in spaced-apart relationship with respect to said conical exit whereby regulated gas is radially distributed from said passageway exteriorly of said air chamber and cylinder.

14. In an air gun having an air valve and regulator system, the improvement which comprises:

an elongated cylinder having an internal air chamber with a pair of ends;

a high pressure air supply connected to a selected end of said chamber; and an air conducting arrangement carried on a non-selected end of said air chamber;

said air arrangement including a circular passageway having a champered, conical discharge exit and a conical dispersement member fixly mounted in said passageway in spaced-apart relationship with respect to said conical exit whereby regulated gas pressure air is radially distributed from said passageway exteriorly of said air chamber and cylinder.

15. A regulator system for an air gun comprising:

a cylindrical body having an internal air chamber;

a high pressure air supply operably coupled to said internal air chamber;

an air regulator having a orifice provided in said cylindrical body and in communication with said internal air chamber;

said air regulator including a dispersal member mounted in said discharge orifice in coaxial relationship with said cylindrical body;

brace means supporting said dispersal member in fixed spaced-apart relationship with respect to said cylindrical body;

said dispersal member being in said orifice so that flow of air from said internal air chamber strikes said dispersal member and is distributed in a radial direction.

16. The regulator system defined in claim 15 wherein:

said dispersal member includes a continuous annular external tapered surface for minimum interference with regulator air from said internal air chamber so as to permit radial distribution of air through said orifice.

* * * * *